United States Patent [19]

Smith

[11] Patent Number: 4,851,630

[45] Date of Patent: Jul. 25, 1989

[54] MICROWAVE REACTIVE GAS GENERATOR

[75] Inventor: Donald K. Smith, Arlington, Mass.

[73] Assignee: Applied Science & Technology, Inc., Cambridge, Mass.

[21] Appl. No.: 210,563

[22] Filed: Jun. 23, 1988

[51] Int. Cl.[4] ..... H05B 6/70

[52] U.S. Cl. ..... 219/10.55 A; 219/10.55 F; 315/39

[58] Field of Search ..... 219/10.55 A, 10.55 F, 219/10.55 R, 10.55 M; 315/39, 111.21; 313/231.31

[56] References Cited

U.S. PATENT DOCUMENTS

| | | | |
|---|---|---|---|
| 4,207,452 | 6/1980 | Arai | 219/10.55 A |
| 4,324,965 | 4/1982 | Naumann et al. | 219/10.55 F |
| 4,339,326 | 7/1982 | Hirose et al. | 219/10.55 A X |
| 4,593,168 | 6/1986 | Amada | 219/10.55 F X |
| 4,681,740 | 7/1987 | Commarmot et al. | 219/10.55 A X |
| 4,689,459 | 8/1987 | Gerling | 219/10.55 A |
| 4,711,983 | 12/1987 | Gerling | 219/10.55 A |

*Primary Examiner*—Philip H. Leung

*Attorney, Agent, or Firm*—Joseph S. Iandiorio; Brian M. Dingman

[57] ABSTRACT

A microwave reactive gas generator including a microwave power source with a waveguide coupled to the power source for transmitting microwave radiation. A cavity for establishing a microwave mode is attached to the waveguide, and there is passage tube through the cavity transverse to the direction of propagation of the microwave radiation in the waveguide for passing the gas to be excited through the cavity. The generator also includes a device for matching the impedance of the load to the microwave power source. The cavity couples the microwave power from the waveguide to the passage to energize the gas into a reactive state.

23 Claims, 2 Drawing Sheets

MICROWAVE REACTIVE GAS GENERATOR

FIELD OF INVENTION

This invention relates to a microwave reactive gas generator and more particularly to an integrated microwave reactive gas generator which produces an axis symmetrically energized reactive gas and is useful with a variety of gases over a wide range of gas pressures and flow rates.

BACKGROUND OF INVENTION

Reactive gases are extremely useful in dry chemistry operations. For example, reactive oxygen can be used to strip photoresist from a semiconductor, and reactive nitrogen can be mixed with silicon compounds to deposit silicon nitride films on substrates.

In these dry chemistry operations, it is desirable to achieve a uniform process by employing a reactive gas which is as uniform as possible. The common method of producing reactive gases is by microwave excitation. Microwave reactive gas production devices are typically tuned waveguides with an applicator at one end. The applicator is simply a shorted waveguide with a gas flow tube running through it. The gas to be excited into a reactive state is pumped through the tube at pressures of approximately 10 Torr, and the microwave field in the waveguide is coupled to the gas to produce a plasma which excites the gas molecules to create the high energy reactive state.

There are several problems with this approach to reactive gas production. First, the microwave source must be tuned to match the impedance of the load. Since the load impedance changes with changes in gas pressure and composition, impedance matching must be performed before each production run. Also, since the impedance of the gas changes as it is excited, during the course of a production run the device must be tuned. Impedance matching is typically accomplished by measuring the forward and reflected power with a separate directional coupler disposed adjacent to the microwave source and adjusting tuning stubs in a separate tuning module disposed between the directional coupler and the waveguide to minimize the reflected power. Thus, the physical size of the separate directional coupler and tuning module make the device impractical for operations in which compact reactive gas generation equipment is required. The tuning may be done manually or with relatively complex automatic tuning equipment, but in either case is costly in production downtime or capital equipment costs.

Even more basic than these physical size and tuning problems is the inherent limitation of the microwave devices. With a shorted waveguide applicator, the gas pressure range over which a reactive gas discharge can be initiated is limited. This is due to the fact that the field in the applicator is simply whatever field is propagated in the waveguide, which severely limits the range of acceptable load impedances. In addition, the nonuniformity of the field in the applicator produces a nonuniformly energized reactive gas, which may contribute to nonuniform downstream processing. This is unacceptable for processing of integrated circuits and other structures in which the uniformity of the gas is critical because of the narrow processing tolerances.

Because of these problems, microwave devices have not been able to fill the need for a reactive gas generator which is compact, simple to use, and effective with a variety of gases at a wide range of pressures and flow rates.

SUMMARY OF INVENTION

It is therefore an object of this invention to provide an integrated microwave reactive gas generator which is relatively small.

It is a further object of this invention to provide a microwave reactive gas generator which produces an extremely uniform gas.

It is a further object of this invention to provide a microwave reactive gas generator which can be used with a variety of gases.

It is a further object of this invention to provide a microwave reactive gas generator which is useful over a wide range of gas pressures.

It is a further object of this invention to provide a microwave reactive gas generator in which load impedance matching is greatly simplified.

This invention results from the realization that a simple and effective microwave reactive gas generator can be accomplished with a system which employs a cavity, formed at the end of the waveguide, in which an axisymmetric field is coupled to a gas discharge tube to axisymmetrically energize the gas, and in which the cavity is a low Q, resonant cavity which provides impedance matching over a broad range of loads.

This invention features a microwave reactive gas generator which includes a microwave power source with a waveguide coupled to the power source for transmitting microwave radiation. There is a cavity, which preferably establishes an axisymmetric microwave mode, attached to the waveguide. A passage means extends through the cavity transverse to the direction of propagation of the microwave radiation in the waveguide for passing a gas to be excited through the cavity. The device also includes means for matching the impedance of the load to the microwave power source. The cavity couples the microwave power from the waveguide to the passage to energize the gas into a reactive state. This microwave reactive gas generator creates a generally uniform gas which is extremely useful for processing integrated circuits, which typically demands gas uniformity. Preferably, the waveguide, cavity, and means for impedance matching are a single, compact, integral structure.

Preferably, the passage means is a dielectric tube which may be quartz. The passage preferably extends through the cavity perpendicular to the direction of propagation. The passage may be centrally disposed in the cavity. Typically, the cavity is approximately one-half wavelength long in a direction transverse to the direction of propagation in the waveguide. The cavity may also be approximately one-half wavelength wide in the direction of propagation in the waveguide. The cavity may be cylindrical with the passage means coaxial with the longitudinal axis of the cylinder. In a preferred embodiment, the cavity is resonant.

The means for matching the impedance of the load to the microwave power source preferably includes a reflected power sensor attached to the waveguide proximate the power source. The means for impedance matching may also include a multistub tuner for canceling reflected power. By including three tuning stubs to match the real and reactive impedance of the load to the microwave source, virtually any load can be matched. Preferably, the tuner is disposed between the power source and the cavity. Alternatively, the means for matching may include a shorted stub tuner.

The field set up in the cavity is typically a transverse electromagnetic mode, or TEM. The passage means may include an opening downstream of the cavity for delivering the reactive gas to a work site. In that case, the passage means preferably includes a bend between the cavity and the opening for blocking passage of ultraviolet radiation to the work site. Finally, the reactive gas generator may further include means for irradiating the gas in the passage to further excite the gas. This may be accomplished by including an ultraviolet source in the cavity for adding additional energy to the gas molecules.

An integrated microwave reactive gas generator, according to this invention, may be accomplished with a microwave power source and a waveguide, which may be rectangular, circular, or elliptic in cross section, coupled to the power source for transmitting the microwave radiation. A low Q resonant cavity is formed at the end of the waveguide. The cavity is approximately one-half wavelength wide in the direction of propagation of the radiation in the waveguide and one-half wavelength high along its axis transverse the direction of propagation. This cavity establishes an axisymmetric microwave mode which is coupled to a dielectric tube aligned coaxially with the axis of the cavity. A gas is passed through the dielectric tube and through the axisymmetric field in the cavity. The field vibrates the electrons at microwave frequencies and excites the gas into an axisymmetrically uniform reactive state. The generator further includes means for matching the impedance of the load to the microwave power source. Typically, the cavity is generally cylindrical. Preferably, the waveguide and cavity are a single integral structure.

DISCLOSURE OF PREFERRED EMBODIMENT

Other objects, features, and advantages will occur from the following description of a preferred embodiment and the accompanying drawings, in which.

Figure 1A:
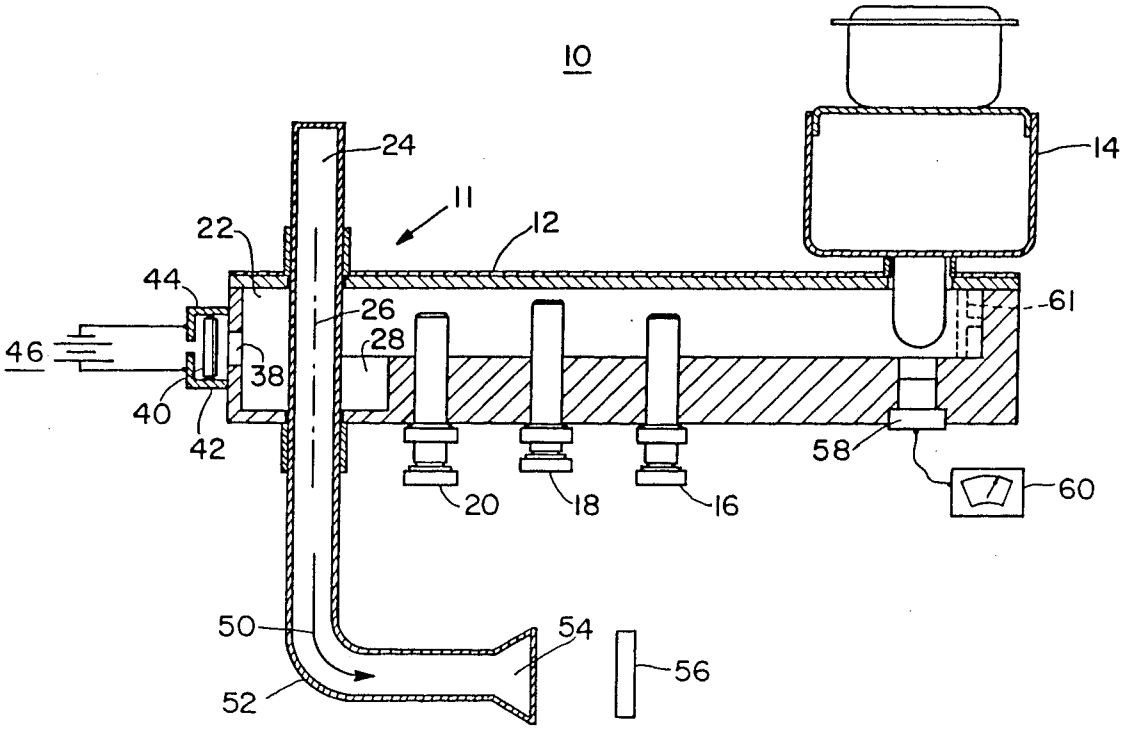
FIG. 1A is an elevational, partial cross-sectional view of a microwave reactive gas generator according to this invention.

There is shown in FIG. 1A microwave reactive gas generator 10 for creating a reactive gas, which typically includes ions and free radicals, for dry chemistry operations. Reactive gas generator 10 includes an integral waveguide and cavity 11. Waveguide 12 is a rectangular waveguide which has magnetron 14 at one end for generating microwaves. The microwave radiation travels through waveguide 12 and is coupled to integral cavity 22 formed at the end of waveguide 12. Cavity 22 is shown as a cylindrical cavity, but may be rectangular or other shapes as well. The generator includes dielectric tube 24 passing through the cavity transverse to the direction of propagation of the microwave radiation in the waveguide. A gas to be excited is pumped through tube 24, and the excited reactive gas passes out through opening 54 to impinge on integrated circuit 56, which is having its photoresist stripped. The reactive gas may be used in a variety of applications, but is especially well suited for etching, deposition, and surface processing of material surfaces.

Microwave reactive gas generator 10 is ideally suited for producing reactive gases for dry chemistry operations. Generator 10 is an integrated system which includes all the elements of the prior art microwave reactive gas generators in a single, compact structure. In addition to being integrated, the microwave reactive gas generator, according to this invention, produces an axisymmetrically energized gas, and may be used over a wide range of load impedances, gas compositions, and gas flow rates and pressures.

Microwave power source 14 is tuned by tuning stubs 16, 18, and 20 in conjunction with reflected power sensor 58. To match the real and reactive load impedance, tuning stubs 16, 18, and 20 are moved in or out of waveguide 12 until the reflected power output on meter 60 is minimized. This indicates a close match of both the real and reactive impedance of the load. Alternatively, one or two stubs may be used in conjunction with shorted stub tuner 61, shown in phantom, which is preferably disposed at the end of waveguide 12 closest to magnetron 14. A dielectric rod adjustably protruding into cavity 22 may also be used to facilitate tuning.

Figure 1B:
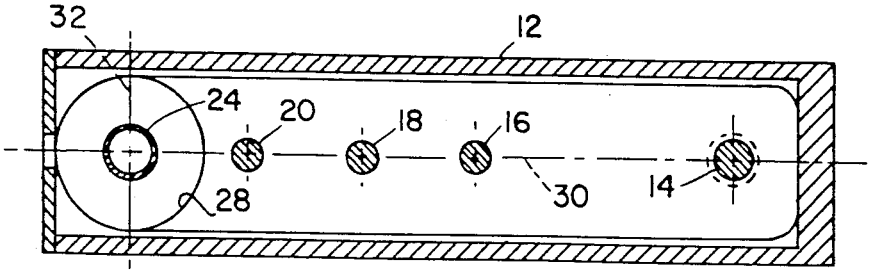
FIG. 1B is a cross-sectional, top plan view of the generator of 1A.

Cavity 22 is machined out the end of waveguide 12 and has a generally cylindrical shape. Machined portion 28 is more clearly shown in FIG. 1B. The cylindrical shaped cavity is dimensioned to form a low Q, resonant cavity in which a standing wave is set up. The low Q cavity gives a broader range of impedance matches because the field strength increases resonantly. This provides a field which is matched over a wide range of gas pressures, compositions and flow rates. At low gas pressures there is little energy absorption and a higher electric field strength is required to properly excite the gas into the reactive state. The prior art shorted waveguide generators cannot match the load impedance under these conditions because they employ a shorted waveguide as the applicator. In the present invention, the standing wave provides an extremely strong field which has enough energy to excite gases at pressures from one quarter to 500 Torr, well in excess of the range of pressures which can be matched by these current devices. In addition, the range of impedances of gases of different compositions and varying flow rates can also be matched by this device.

Tube 24 is a dielectric tube which is preferably quartz or ceramic. Tube axis 26 is coaxial with the longitudinal axis of cylindrical cavity 22. This is more clearly shown in FIG. 1B in which tube 24 is centrally disposed within cavity 28 and falls along center line 30 of waveguide 12 and center line 32 of cavity 22.

Optional ultraviolet light 40, FIG. 1A, is supported and energized through contacts 42 and 44 connected to power source 46. Hole 38 in the end wall of cavity 22 allows the ultraviolet rays to fall on tube 24. Light 40 is used for initial ionization of the gas flowing through cavity 22 to enhance the establishment of a plasma. Hole 38 is sealed with a window, not shown. As the gas absorbs energy creating a plasma, free radicals, dissociated molecules, and excited molecules are formed. Also, some molecules and atoms radiate over a broad spectral range including UV wavelengths. By providing bend 52 in tube 24 upstream of processing area 54, UV radiation created by ionization does not impinge on integrated circuit 56. Since UV tends to harden photoresists and damage substrates and films, it may be desirable to remove the UV before the work site is reached. Also, by making tube 24 long enough so that the gas residence time downstream of cavity 22 is more than approximately one millisecond, the ions tend to recombine, which leaves an ion-free excited gas, decreasing damage to sensitive devices.

Figure 2B:
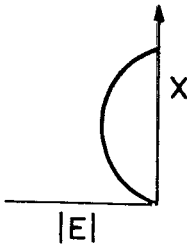
FIG. 2B is a graphic depiction of the field strength in the cavity of the generator of FIG. 2A.
Figure 2A:
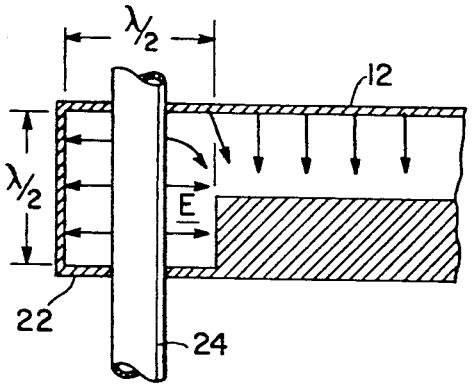
FIG. 2A is a schematic diagram of the microwave field in the waveguide and cavity of the generator of FIG. 1A.
Figure 2C:
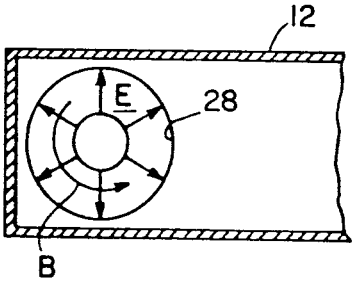
FIG. 2C is a top plan view of the generator of FIG. 2A showing the transverse electromagnetic field in the cavity.

The field in the waveguide and cavity are schematically depicted in FIGS. 2A through 2C. FIG. 2A depicts field E in waveguide 12 and cavity 22. As can be seen, with cavity 22 having a height and width of approximately one-half wavelength, an axisymmetric transverse electromagnetic mode is set up in the cavity. This mode is an axisymmetric standing wave which can be coupled to a variety of loads to axisymmetrically energize the gas into a reactive state. This uniformity of energization is what provides the gas uniformity desirable in dry chemistry operations.

The strength of the field in cavity 22 is shown in FIG. 2B, in which field strength $|E|$ is plotted against distance X from the bottom of cavity 22. Finally, the top view of FIG. 2C depicts electric field E and magnetic field B of the transverse electromagnetic mode set up in resonant cavity 22. As can be seen from FIGS. 2A through 2C, cavity 22 supports an axisymmetric TEM mode which matches a wide range of loads and produces an axisymmetrically energized reactive gas ideally suited for delicate dry chemistry operations.

Although specific features of the invention are shown in some drawings and not others, this is for convenience only as each feature may be combined with any or all of the other features in accordance with the invention.

Other embodiments will occur to those skilled in the art and are with the following claims:

What is claimed is:

1. A microwave reactive gas generator, comprising:

a microwave power source;

a waveguide coupled to said power source for transmitting microwave radiation therethrough;

passage means extending transverse to the direction of propagation of the microwave radiation in said waveguide for passing a gas to be excited;

a resonant cavity attached to said waveguide and aligned coaxially with said passage means for coupling the microwave power from said waveguide to said passage means to energize said gas into a reactive state; and means for matching the impedance of the load to the microwave power source.

2. The generator of claim 1 in which said passage means extends through said cavity perpendicular to the direction of propagation in said waveguide.

3. The generator of claim 2 in which said passage means is centrally disposed in said cavity.

4. The generator of claim 1 in which said means for matching includes a reflected power sensor attached to said waveguide proximate said power source.

5. The generator of claim 1 in which said means for matching includes a multistub tuner for cancelling reflected power.

6. The generator of claim 5 in which said tuner is disposed between said power source and said cavity.

7. The generator of claim 5 in which said tuner includes three tuning stubs for matching the real and reactive impedance of the load to the microwave source.

8. The generator of claim 1 in which said cavity is approximately one-half wavelength long in a direction transverse to the direction of propagation in said waveguide.

9. The generator of claim 1 in which said cavity is generally cylindrical.

10. The generator of claim 9 in which said passage means is coaxial with the longitudinal axis of said cylindrical cavity.

11. The generator of claim 1 in which said passage means includes a dielectric tube.

12. The generator of claim 1 in which said cavity establishes an axisymmetric microwave mode therein.

13. The generator of claim 1 further including means for irradiating the gas in said passage means to further excite said gas.

14. The generator of claim 13 in which said means for irradiating includes an ultraviolet source in said cavity.

15. The generator of claim 1 in which said cavity is approximately one-half wavelength wide in the direction of propagation in said waveguide.

16. The generator of claim 1 in which said passage means includes an opening downstream of said cavity to deliver the reactive gas to a work site.

17. The generator of claim 16 in which said passage means includes a bend between said cavity and said opening for blocking passage of ultraviolet radiation to said work site.

18. The generator of claim 1 in which said means for matching includes a shorted stub tuner.

19. The generator of claim 1 in which the field in said cavity is a transverse electromagnetic mode.

20. The generator of claim 1 in which said waveguide and said cavity are an integral structure.

21. An integrated microwave reactive gas generator, comprising:

a microwave power source;

a waveguide coupled to said power source for transmitting microwave radiation therethrough;

a low Q resonant cavity formed at one end of said waveguide for establishing an axisymmetric microwave mode therein, said cavity being approximately one-half wavelength wide in the direction of propagation of said radiation in said waveguide and one-half wavelength high along its axis transverse to said direction of propagation;

a dielectric tube coaxial with the axis of said cavity for passing a gas through said axisymmetric field to energize the gas into a reactive state; and means for matching the impedance of the load to the microwave power source.

22. The generator of claim 21 in which said cavity is generally cylindrical.

23. The generator of claim 21 in which said waveguide and said cavity are an integral structure.

* * * * *